US006125726A

United States Patent [19]

Vendetti et al.

[11] Patent Number: 6,125,726

[45] Date of Patent: Oct. 3, 2000

[54] TOOL FOR ATTACHING TO AN ELEMENT FOR HANDLING THEREOF

[75] Inventors: Mark J. Vendetti, Waterbury; Jason M. Goslicki, Nagatuck; William J. Lutkus, Watertown, all of Conn.

[73] Assignee: Emhart Inc., Newark, Del.

[21] Appl. No.: 09/001,898

[22] Filed: Dec. 31, 1997

[51] Int. Cl.[7] ..... B25B 23/08; B25B 23/10

[52] U.S. Cl. ..... 81/447

[58] Field of Search ..... 81/53.2, 442, 447, 81/459

[56] References Cited

U.S. PATENT DOCUMENTS

| | | | |
|---|---|---|---|
| 268,408 | 12/1882 | Jackson . | |
| 1,522,968 | 1/1925 | Milligan . | |
| 1,909,702 | 5/1933 | Mitchell . | |
| 2,121,197 | 6/1938 | Jackman | 81/441 |
| 2,360,054 | 10/1944 | Haas . | |
| 2,550,866 | 5/1951 | Rosan | 81/53.2 |
| 2,747,447 | 5/1956 | Metcalf | 81/121.1 |
| 2,949,800 | 8/1960 | Neuschotz | 81/53.2 |
| 2,951,406 | 9/1960 | Brase | 81/459 |
| 3,152,495 | 10/1964 | Neuschotz | 81/53.2 |
| 3,269,225 | 8/1966 | Neuschotz | 81/53.2 |
| 3,280,666 | 10/1966 | Neuschotz | 81/53.2 |
| 3,290,968 | 12/1966 | Parnock et al. | 81/53.2 |
| 3,446,101 | 5/1969 | McKay | 81/53.2 |
| 3,545,066 | 12/1970 | Stillman et al. | 29/240 |
| 3,584,526 | 6/1971 | Kleinhenn | 81/53.2 |
| 3,603,180 | 9/1971 | Alexander | 81/53.2 |
| 3,619,892 | 11/1971 | Roeschlaub . | |
| 3,740,814 | 6/1973 | Marshall | 29/264 |
| 3,864,806 | 2/1975 | Hanson et al. . | |
| 4,325,665 | 4/1982 | Jukes . | |
| 4,960,017 | 10/1990 | Hsiao | 81/459 |
| 5,138,909 | 8/1992 | Johnson | 81/53.2 |
| 5,253,556 | 10/1993 | Kelly et al. | 81/53.2 |
| 5,402,694 | 4/1995 | Kelly et al. | 81/53.2 |
| 5,492,039 | 2/1996 | Haikal et al. | 81/53.2 |
| 5,513,545 | 5/1996 | George | 81/53.2 |
| 5,906,146 | 5/1999 | Arlen | 81/53.2 |

*Primary Examiner*—Timothy V. Eley
*Attorney, Agent, or Firm*—Edward D. Murphy

[57] ABSTRACT

A tool 32 is used to assemble a spark plug insert 24 within an oversize threaded passage 26 of an engine block 20. The tool 32 includes a mandrel 48 which is formed with a threaded extension 60, and also includes a pliable bushing 34 having a cylindrical section 36, a flange 38 at one end thereof and a passage 40. A nut 44 is embedded in the pliable bushing 34 and is formed with threads 46 which are in axial alignment with the passage 40 of the pliable bushing 34. The threaded extension 60 is inserted into the passage 40 of the pliable bushing 34 and into threaded engagement with the nut 44. The cylindrical section 36 is inserted into an inner opening of the insert 24 and the mandrel 48 is rotated relative to the pliable bushing 34 to draw the nut 44 toward the flanged end of the bushing. This action causes the cylindrical section 36 to be compressed axially and to expand outward radially whereby the expanded portions of the section are worked into the spaces between threads 30 to attach the pliable bushing 34 to the insert 24. The mandrel 48 is then manipulated to install the attached insert 24 into the passage 26 of the engine body 20.

11 Claims, 3 Drawing Sheets

TOOL FOR ATTACHING TO AN ELEMENT FOR HANDLING THEREOF

BACKGROUND OF THE INVENTION

This invention relates to methods of and a tool for attaching to an element, and particularly relates to methods of and a tool for attaching to an insert to facilitate assembly of the insert with a support structure.

Spark plugs are a crucial element in the operation of internal combustion engines. Typically, such engines include an engine block having specifically located threaded ports for receipt of a correspondingly threaded portion of the spark plugs. During the life of the engine, the spark plugs may be removed from the respective ports for testing, cleaning and/or replacement. Frequent removal, reinsertion and/or replacement of the spark plugs results in damage to and/or wear of the threads in the ports of the engine block to the extent that the ports can no longer support the spark plugs, or can not accept the spark plugs in the firm manner, necessary for the efficient and effective operation of the engine. In such instances, the ports must be revitalized for continued use of the engine.

In one technique used to revitalize the damaged or worn threads of the spark plug ports, the port is bored initially to form an oversize, smooth-walled passage about the centerline of the existing port, whereby the original defective threads are completely removed. The oversize passage is then tapped to form threads of a prescribed size. A commercially available insert, having threads on the outer surface consistent with the prescribed size, and threads on the inner surface consistent with the standard spark plug threads, is installed in the threaded oversize passage. The spark plug can now be assembled with the threaded inner surface of the insert which forms a new or revitalized port.

The insert could be a bushing, referred to herein as a "bushing insert," having an axial passage therethrough, with outer threads formed on an outer surface thereof in an axial direction, and inner threads formed on an inner surface thereof in the axial direction.

The insert could also be made from a preformed metal wire, typically formed with a diamond cross section, which is wound to form a helical coil having successive convolutions. The helical coil is referred to herein as a "coil insert." The coil insert is wound in such a manner that outer and inner threads are formed by sharp, generally "V" shaped portions on opposite sides of the diamond cross section on the outer and inner surfaces, respectively, of the insert.

The size of the outer threads of the bushing insert and the coil insert are consistent with the size of the threads of the oversize passage, and the size of the inner threads of the bushing insert and the coil insert are consistent with the size of the threads typically formed on a portion of the outer surface of the spark plug.

In the past, the bushing and coil inserts have been assembled by hand, or by use of a spark plug serving as an insertion tool. When using the spark plug for assembling the bushing inserts or the coil inserts, the spark plug is threadedly assembled with the inner threads of the insert to form an insert-spark plug assembly. The assembly is then manipulated to position the insert into the oversize threaded passage where the outer threads of the insert are threadedly assembled with the threads of the oversize passage. While either technique is tedious at best, the assembly process is further compounded by the fact that many spark plug ports are located in deeply recessed portions of the outer surface of the engine block due to the shape of the block.

A compound, such as high temperature RTV silicone, is placed on the outer threads of the insert prior to its assembly with the oversize passage. When the silicone cures, a sealing and locking bond is formed between the threads of the oversize passage and the outer-surface threads of the insert. During the curing period, the spark plug used for assembling the insert must remain in place until the silicone cures, which delays the process of revitalizing the ports of the block.

Thus, there is a need for a tool which will attach to the insert to facilitate the handling of the insert as desired. Further, there is a need for a tool which will attach to the insert to facilitate the rapid and effective assembly of outer threads of the insert within a passage having threads of a prescribed size, even though the passage is located at the base of a deep recess. Also, there is a need for a tool which can be detached from attachment with the insert immediately upon assembly of the insert within the passage notwithstanding the presence of an uncured locking and sealing compound between the threads of the passage and the outer threads of the insert.

There is also a need for methods of attaching to the insert for the handling thereof, for inserting the insert into the threaded passage, and for detaching from the insert without movement of the assembled insert.

SUMMARY OF THE INVENTION

It is, therefore, an object of this invention to provide a tool for attaching to an element to facilitate handling of the element as desired.

Another object of this invention is to provide a tool for attaching to an insert to facilitate assembly of the insert with a support structure.

Still another object of this invention is to provide a tool which will attach to the insert to facilitate the rapid and effective assembly of the insert with a support structure.

A further object of this invention is to provide a tool which will facilitate the assembly of an insert within a port located in a deep recess of the support structure.

An additional object of this invention is to provide a tool which can be detached from an insert following assembly of the insert with a support structure without engaging the assembled insert.

Another object of this invention is to provide, alternatively, methods of (1) attaching to an insert to facilitate the desired handling thereof, (2) inserting the insert into an opening of a support structure, and (3) detaching from the insert without engaging the insert in its assembled position.

With these and other objects in mind, this invention contemplates a tool for handling an element formed with an opening having an inner wall of a prescribed size. The tool includes a pliable member having a peripheral shape at a size smaller than the prescribed size. The tool further includes a non-pliable member attached to the pliable member, and means for moving the non-pliable member relative to the pliable member for expanding the pliable member into attaching engagement with the inner wall of the element. An actuator is included in the tool and is positioned for engagement with the means for moving and for expanding to facilitate selective operation of the tool.

This invention further contemplates a method of handling an element which is formed with an opening having an inner wall of a prescribed size. A pliable member, having a peripheral exterior which is smaller than the prescribed size, is inserted into the opening of the element. At least a portion of the peripheral exterior of the pliable member is expanded into the inner wall of the element for attachment thereto. The pliable member is selectively maneuvered for handling of the element.

Other objects, features and advantages of the present invention will become more fully apparent from the following detailed description of the preferred embodiment, the appended claims and the accompanying drawings.

DETAILED DESCRIPTION OF THE PREFERRED EMBODIMENT

Figure 1:
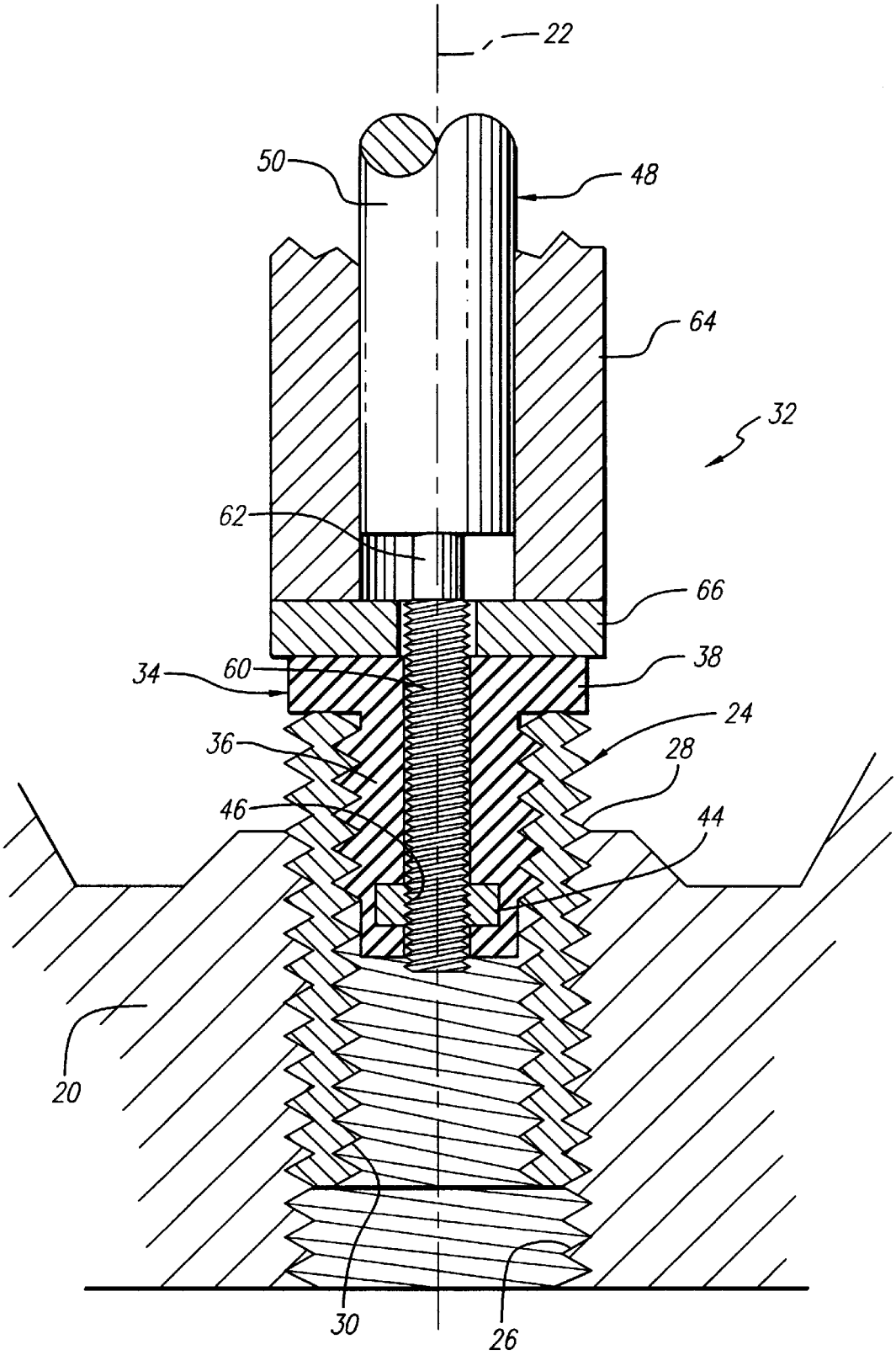
FIG. 1 is a sectional view showing a tool in the process of assembling an insert into a spark plug port of an internal combustion engine in accordance with certain principles of the invention.

As shown in FIG. 1, an engine block 20 of an internal combustion engine (not shown) is normally formed with a plurality of spark plug ports (not shown), each of which is formed about a respective centerline 22. Each of the ports is formed initially with threads which are of the same size as threads formed on a conventional spark plug (not shown), which is eventually threadedly assembled within the threaded port for normal use. During the life of the engine block 20, the spark plugs may be removed from the block many times for testing, cleaning and/or replacement. This could result in wear and/or damage to the threads of the port to the extent that eventually the spark plug could not be properly supported with the engine block 20 for effective and efficient operation of the engine.

Figure 2:
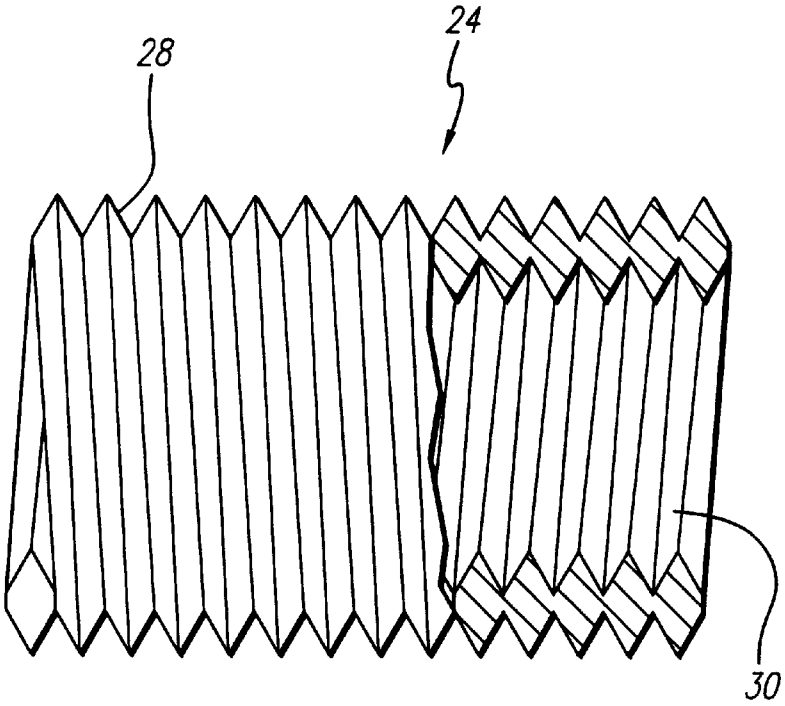
FIG. 2 is a partial sectional view showing the structure of the insert of FIG. 1.

In the past, a bushing insert 24 (FIGS. 1 and 2) has been used for facilitating the effective reconstruction of the port. In the reconstruction process, the port is bored to remove the worn or damaged threads, whereby an oversize, smooth-walled passage is formed about the centerline 22. The passage is then tapped to form an oversize threaded passage 26 having threads of a prescribed size.

The bushing insert 24 forms an element which is shaped as a sleeve or cylinder having outer threads 28 formed on the exterior thereof, and inner threads 30 formed on the interior thereof. The outer threads 28 are of the prescribed size, and the inner threads 30 are the same size as the threads on the exterior of a conventional spark plug. Consequently, the inner threads 30 of the insert 24 are of the same size as the worn or damaged threads which were formed in the original port. Further, the minor diameter of the inner threads of the bushing insert is referred to herein as the prescribed diameter, and could be considered as representative of the diameter of a threadless passage formed within the bushing insert 24 at the prescribed diameter.

A liquid material, such as a high-temperature RTV silicone is applied to the outer threads 28 of the bushing insert 24, and the insert is threadedly assembled within the passage 26. The silicone material is eventually cured and forms a locking and sealing agent between the threads of the passage 26 and the outer threads 28.

Also in the past, the bushing insert 24 was assembled with the oversize threaded passage 26 by hand or by use of an assembly spark plug which was pre-assembled with the insert, and then assembled within the oversize threaded passage. At times, the oversize threaded passage 26 of the engine block 20 was deeply recessed and was difficult to reach for assembly by hand, and even by use of the assembly spark plug.

Figure 3:
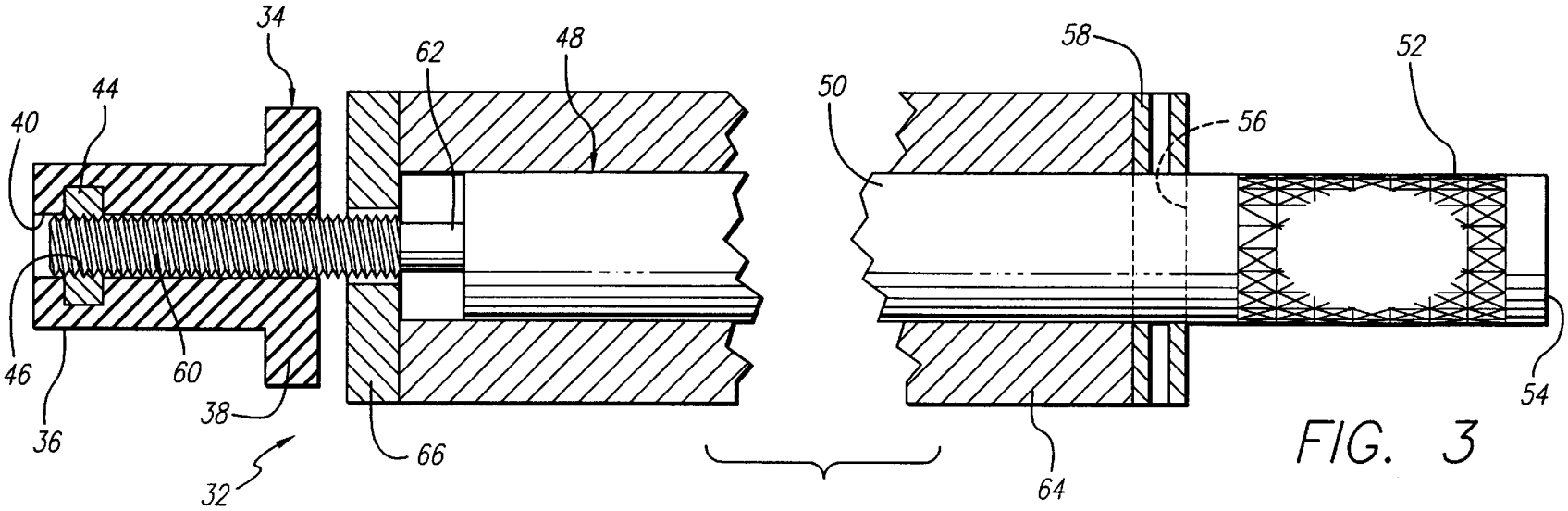
FIG. 3 is a sectional view showing the components of the tool of FIG. 1 in accordance with certain principles of the invention.

Referring to FIGS. 1 and 3, to alleviate the problem caused by the recessed passage 26, a tool 32, and methods, were developed with facility for attaching to the bushing insert 24 to facilitate general handling of the insert such as, for example, during the application of the silicone to the outer threads 28 of the bushing insert 24. In particular, the tool 32 facilitates eventual insertion of the insert into the threaded passage 26 of the engine block 20.

Figure 5:
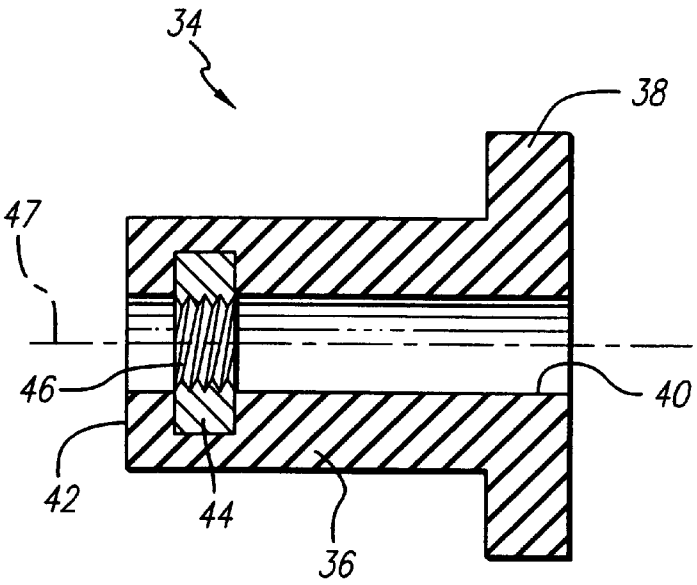
FIG. 5 is a sectional view showing a compliant or pliable bushing encapsulating a metal washer of FIG. 1 in accordance with certain principles of the invention.

The tool 32 includes a pliable member or bushing 34, as shown in FIG. 5, which is preferably composed of neoprene, but could be composed of any other suitably pliable material such as rubber or rubber-like material. The pliable bushing 34 is formed with a cylindrical section 36 and a flange 38 at one end thereof, with a axial passage 40 extending through the bushing from the flanged end to a non-flanged end 42. A non-pliable member or nut 44, preferably a brass nut, is molded or captured within the pliable bushing 34 and is formed with a threaded passage 46 which is aligned with an axis 47 (FIG. 5) of the passage 40.

It is noted that the normal shape of the section 36 of the pliable bushing 34 is cylindrical. Also, the diameter of the exterior of the cylindrical section 36 of the pliable bushing 34 is less than the prescribed diameter and, therefore, can be inserted into the interior passage of the bushing insert 24.

Figure 4:
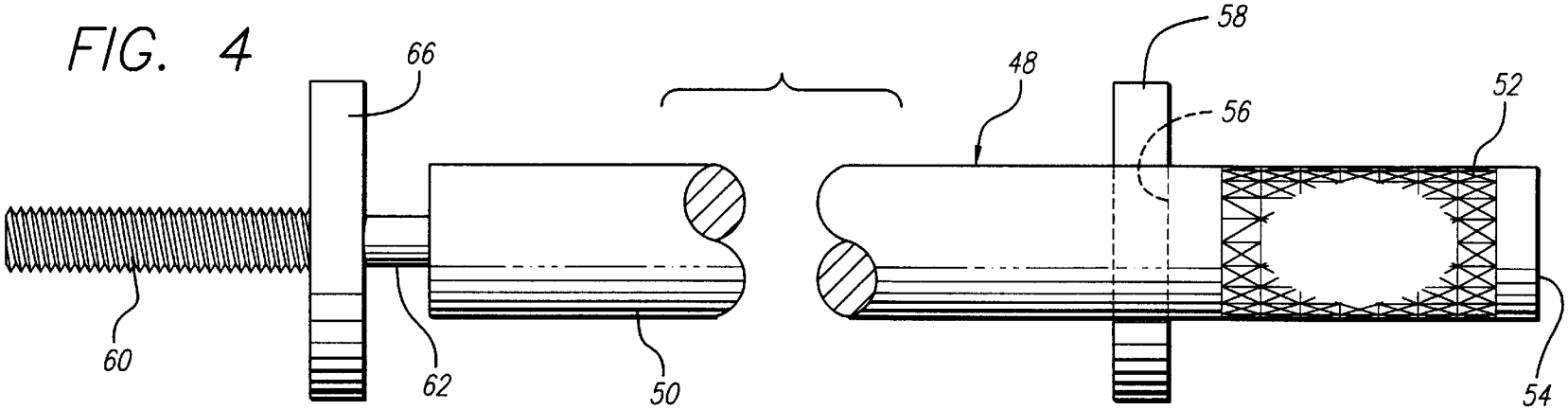
FIG. 4 is a partial view of a portion of the tool of FIG. 1 in accordance with certain principals of the invention.

Referring to FIG. 4, the tool 32 also includes a metal mandrel 48 having a main body 50 which extends axially for a major portion thereof. The mandrel 48 is formed with a knurled section 52 on the periphery of main body near one end 54. The mandrel 48 is formed with a transaxial passage 56 through the body 50 for receipt of a roll pin 58 near an inboard end of the knurled section 52. A threaded axial extension 60 of the mandrel 48 is formed at an opposite end of the mandrel 48 at a diameter somewhat less than the diameter of the body 50 and is coupled to the body through an undercut section 62 of the mandrel. The threads of the extension 60 are the same size as the threads 46 of the nut 44.

As shown in FIG. 3, the tool 32 also includes a metal sleeve 64 which is positioned over a major portion of the body 50 and located, at one end of the sleeve, against the roll pin 58. The opposite end of the sleeve 64 is located over the undercut section 62 and abuts a metal washer 66 which is positioned on, and located at the inboard end of, the threaded extension 60.

The threaded extension 60 of the mandrel 48 is inserted into the flanged end of the unthreaded passage 40 of the pliable bushing 34, and is threadly assembled with the threads 46 of the nut 44, as shown in FIG. 3, until a flat outer face 68 of the flange 38 engages the washer 66. This completes the assembly of the components of the tool 32.

When using the tool 32 to assemble the bushing insert 24 within the oversize threaded passage 26, the pliable bushing 34 is inserted into the passage of the bushing insert 24 which is formed with the inner threads 30. Since the diameter of the exterior of the cylindrical section 36 is less than the prescribed diameter, the cylindrical section is freely insertible into the interior passage of the bushing insert 24 without interference from the inner threads 30 of the insert.

Referring to FIG. 1, the mandrel 48 is thereafter rotated, for example, by gripping and turning the knurled section 52, and thereby functions as an actuator in the operation of the tool 32. Since the flange 38 of the pliable bushing 34 is abutting the washer 66, the nut 44 will be drawn axially toward the flange as the mandrel 48 is rotated. The axial movement of the nut 44 toward the flange 38 compresses a work volume of the neoprene material of the pliable bushing 34 axially between the nut and the flange 38. This axial compression results in an expansion of the work volume of the material radially outward from the axis of the pliable bushing 34 to the extent that the peripheral portions of the work volume of the pliable neoprene material fills in the spaces between adjacent threads 30 of the bushing insert 24, as shown in FIG. 1. In this manner, the tool 32 becomes attached to the bushing insert 24 which can now be handled as desired. The nut 44 could also serve as a threaded element of the pliable bushing 34 to the extent that the mandrel 48 can be attached to the bushing and serve as a handle, after the threaded extension 60 has been threadedly assembled with the nut, which facilitates handling of any element attached to the bushing.

It is noted that the interior of the bushing insert 24 could be formed in a shape other than with the threads 30, and the tool 32 could still be used to attach to the insert in the manner described above without departing from the spirit and scope of the invention. For example, the interior of the bushing insert 24 could be a smooth wall, or could be formed with a random shape other than threads, and the peripheral portions of the work volume of the pliable neoprene would still attach to the interior of the insert in the manner described above.

After the pliable bushing 34 is attached to the threads 30 of the bushing insert 24, the high temperature RTV silicone is applied to the outer threads 28 of the bushing insert. The insert 24 is then positioned at the mouth of the oversize threaded passage 26 whereafter the mandrel 48 is rotated to threadedly move the insert into the oversize passage of the engine block 20 and thereby facilitate the assembly of the insert with the block.

Due to the extended length of the tool 32, an installer can easily locate the bushing inserts 24 within any of the oversize passages 26 of the engine block 20, including any deeply recessed oversize passages, thereby alleviating the problem noted above.

In the past, the installer had to wait until the silicone cured before any effort was made to remove the spark plug, which was used to install the bushing insert 24 with the block 20. This was necessary to insure that no movement of the spark plug would occur which could disturb the uncured silicone during its curing stage. When using the tool 32, the expanded peripheral portion of the pliable bushing 34 can be detached from engagement with the inner threads 30 of the bushing insert 24 as soon as the insert is fully positioned in assembly with the engine block 20. Further, such detachment of the pliable bushing 34 can be accomplished without movement of the bushing insert 24, thereby allowing the silicone to continue through its curing process while removing the tool 32 from the assembly position.

The detachment process noted above is accomplished by rotating the mandrel 48 in a reverse direction immediately upon full assembly of the bushing insert 24 with the engine block 20. As the threaded extension 60 is reversed through the nut 44, the pliable bushing 34 begins to relax and return to its normal cylindrical shape, as shown in FIGS. 3 and 5. During this period, the peripheral portions of the expanded neoprene of the pliable bushing 34 are moving generally laterally away from the inner threads 30 of the bushing insert 24 thereby detaching and disengaging from the interior of the insert. When the pliable bushing 34 has returned to its normal shape, the tool 32 is manipulated to withdraw the bushing from within the interior of the bushing insert 24 without the necessity of engaging any portion of the insert. This allows the removal of the bushing 34 while the silicone is processing through its curing stage.

It is noted that the bushing insert 24 is a commercially available fastener marketed under the registered trademark "WELL-NUT" which is owned by The Black & Decker Corporation. The fastener is typically used to attach articles to a support structure. For example, a portion of the article to be supported is placed over the cylindrical section of the fastener and against the inboard side of the flange. Thereafter, the non-flange end of the cylindrical section is placed through a hole from one side of the support structure and extends from the opposite side of the support structure. A screw is inserted into the flanged end of the axial passage and threadedly engages the nut. As the screw is passed further through the nut, the cylindrical section compresses axially and expands radially to a size larger than the hole in the support structure whereby the fastener and the article are retained with the support structure.

The tool 32 can be used to attach to articles having accessible interior of a variety of shapes and configurations, as noted above, in accordance with certain principles of the invention. Further, the tool 32 facilitates the handling of the attached article for a desired purpose, and facilitates detachment from the article without disturbing the article in its final setting. The tool 32 can be used with ease and rapidity to assemble an article within a deep recess of a support structure. In addition, the facilitation of the tool 32 provides enhanced processes in the attachment to an article, the handling of the article, and the detachment from the article.

In general, the above-identified embodiments are not to be construed as limiting the breadth of the present invention. Modifications, and other alternative constructions, will be apparent which are within the spirit and scope of the invention as defined in the appended claims.

What is claimed is:

1. A tool for handling an element formed with an opening having an inner wall of a prescribed size, which comprises:

a pliable member having a peripheral shape at a size smaller than the prescribed size;

a non-pliable member attached to the pliable member;

means for moving the non-pliable member relative to the pliable member for expanding the pliable member into attaching engagement with the inner wall of the element; and an actuator positioned for engagement with the means for moving and for expanding to facilitate selective operation of the tool.

2. A tool for attaching to an insert formed with an opening having an inner wall of a prescribed size, which comprises:

a pliable member having a peripheral shape at a size smaller than the prescribed size;

a non-pliable member attached to the pliable member;

means for moving the non-pliable member relative to the pliable member for expanding the pliable member into attaching engagement with the inner wall of the insert; and an actuator positioned for engagement with the means for moving and for expanding to facilitate selective operation of the tool.

3. The tool as set forth in claim 2, wherein the inner wall of the insert is smooth and the pliable member is formed with an outer surface which is normally smooth.

4. The Tool as set forth in claim 2, wherein the inner wall of the insert is formed with radially inward projections and the pliable member is formed with an outer surface which is normally smooth.

5. The tool as set forth in claim 2, wherein the pliable member is composed of a material which maintains a normal configuration, can be manipulated under force to assume an abnormal configuration, and returns to the normal configuration upon withdrawal of the force.

6. The tool as set forth in claim 5, wherein the material is neoprene.

7. The tool as set forth in claim 2, wherein at least a portion of the pliable member is normally shaped in a cylindrical configuration.

8. The tool as set forth in claim 2, wherein the non-pliable member is a threaded nut embedded within the pliable member.

9. The tool as set forth in claim 8, wherein the means for moving and for expanding is a threaded extension in threaded assembly with the nut which is rotatable externally of the pliable member.

10. The tool as set forth in claim 9, wherein the actuator is a mandrel having the threaded extension extending therefrom for rotating the extension upon actuating rotation of the mandrel.

11. A tool for attaching to an element formed with an opening of a prescribed size and an inner wall of a prescribed configuration and size, which comprises:

a mandrel mounted for rotation;

an extension formed with threads of a given size and extending from the mandrel for rotation therewith;

a pliable member having a passage formed therein for receipt of the extension and formed with a section of a normal external configuration and a size smaller than the prescribed size of the inner wall of the element;

a non-pliable member attached to the pliable member and formed with threads of the same size as the threads of the extension and located on the pliable member for threaded engagement with the extension;

means for facilitating relative rotation between the non-pliable member and the extension with the threads thereof being in threaded engagement; and means responsive to the relative rotation between the threadedly engaged non-pliable member and extension for expanding the section of the pliable member radially outward of the normal external configuration and into conforming engagement with the inner wall of the element to thereby attach to the element.

* * * * *